US006634050B1

(12) United States Patent
Barboza

(10) Patent No.: US 6,634,050 B1
(45) Date of Patent: Oct. 21, 2003

(54) CLEANING APPARATUS

(76) Inventor: Luis A. Barboza, 173 Elm St., Kearny, NJ (US) 07032

( * ) Notice: Subject to any disclaimer, the term of this patent is extended or adjusted under 35 U.S.C. 154(b) by 0 days.

(21) Appl. No.: 09/497,900

(22) Filed: Feb. 4, 2000

(51) Int. Cl.[7] ..... A46B 13/06
(52) U.S. Cl. ..... 15/29
(58) Field of Search ..... 15/29, 97.1

(56) References Cited

U.S. PATENT DOCUMENTS

| | | | | | |
|---|---|---|---|---|---|
| 2,599,911 | A | | 6/1952 | Haines | |
| 2,723,407 | A | | 11/1955 | Bardon | |
| 3,906,574 | A | * | 9/1975 | Kaeser | 15/29 |
| 4,204,292 | A | | 5/1980 | Lester et al. | |
| D262,670 | S | | 1/1982 | Wellin | |
| 4,370,771 | A | | 2/1983 | Gonzalvo | |
| 4,513,466 | A | * | 4/1985 | Keddie | 15/29 |
| D315,251 | S | | 3/1991 | Clivio | |
| 5,687,442 | A | * | 11/1997 | McLain | 15/29 |
| 6,021,539 | A | * | 2/2000 | Zhadanov | 15/29 |

FOREIGN PATENT DOCUMENTS

| | | | | |
|---|---|---|---|---|
| CA | 1155260 | * | 10/1983 | 15/29 |
| DE | 3138383 | * | 4/1983 | 15/29 |
| EP | 0280833 | * | 9/1988 | 15/29 |
| GB | 2175494 | * | 12/1986 | 15/29 |
| GB | 2261814 | * | 6/1993 | 15/29 |
| JP | 5-23218 | * | 2/1993 | 15/29 |

* cited by examiner

*Primary Examiner*—Randall E. Chin

(57) ABSTRACT

A cleaning apparatus for cleaning with a rotary brush while delivery water to the area to be cleaned. The cleaning apparatus includes a housing. The housing has a distal side and a proximal side. The housing has a top wall and a peripheral wall attached to and extending away from a peripheral edge of the top wall. The top wall and the peripheral wall bound an interior portion of the housing. The peripheral wall has a free edge. A washing means for washing a surface comprises a first scrubbing means for scrubbing a surface. The first scrubbing means is mounted in the housing. The first scrubbing means is generally adjacent to the free edge of the peripheral wall. A delivery means delivers liquid to the washing means and is fluidly coupled to the distal end of the housing.

9 Claims, 6 Drawing Sheets

CLEANING APPARATUS

BACKGROUND OF THE INVENTION

1. Field of the Invention

The present invention relates to cleaning tools and more particularly pertains to a new cleaning apparatus for cleaning with a rotary brush while delivery water to the area to be cleaned.

2. Description of the Prior Art

The use of cleaning tools is known in the prior art. More specifically, cleaning tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,370,771; U.S. Pat. No. 2,723,407; U.S. Pat. No. 2,599,911; U.S. Pat. No. 4,204,292; U.S. Des. Pat. No. 262,670; and U.S. Des. Pat. No. 315,251.

While these devices fulfill their respective, particular objectives and requirements, the aforementioned patents do not disclose a new cleaning apparatus. The inventive device includes a housing. The housing has a distal side and a proximal side. The housing has a top wall and a peripheral wall attached to and extending away from a peripheral edge of the top wall. The top wall and the peripheral wall bound an interior portion of the housing. The peripheral wall has a free edge. A washing means for washing a surface comprises a first scrubbing means for scrubbing a surface. The first scrubbing means is mounted in the housing. The first scrubbing means is generally adjacent to the free edge of the peripheral wall. A delivery means delivers liquid to the washing means and is fluidly coupled to the distal end of the housing.

In these respects, the cleaning apparatus according to the present invention substantially departs from the conventional concepts and designs of the prior art, and in so doing provides an apparatus primarily developed for the purpose of for cleaning with a rotary brush while delivery water to the area to be cleaned.

SUMMARY OF THE INVENTION

In view of the foregoing disadvantages inherent in the known types of cleaning tools now present in the prior art, the present invention provides a new cleaning apparatus construction wherein the same can be utilized for cleaning with a rotary brush while delivery water to the area to be cleaned.

The general purpose of the present invention, which will be described subsequently in greater detail, is to provide a new cleaning apparatus apparatus and method which has many of the advantages of the cleaning tools mentioned heretofore and many novel features that result in a new cleaning apparatus which is not anticipated, rendered obvious, suggested, or even implied by any of the prior art cleaning tools, either alone or in any combination thereof.

To attain this, the present invention generally comprises a housing. The housing has a distal side and a proximal side. The housing has a top wall and a peripheral wall attached to and extending away from a peripheral edge of the top wall. The top wall and the peripheral wall bound an interior portion of the housing. The peripheral wall has a free edge. A washing means for washing a surface comprises a first scrubbing means for scrubbing a surface. The first scrubbing means is mounted in the housing. The first scrubbing means is generally adjacent to the free edge of the peripheral wall. A delivery means delivers liquid to the washing means and is fluidly coupled to the distal end of the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cleaning apparatus apparatus and method which has many of the advantages of the cleaning tools mentioned heretofore and many novel features that result in a new cleaning apparatus which is not anticipated, rendered obvious, suggested, or even implied by any of the prior art cleaning tools, either alone or in any combination thereof.

It is another object of the present invention to provide a new cleaning apparatus which may be easily and efficiently manufactured and marketed.

It is a further object of the present invention to provide a new cleaning apparatus which is of a durable and reliable construction.

An even further object of the present invention is to provide a new cleaning apparatus which is susceptible of a low cost of manufacture with regard to both materials and labor, and which accordingly is then susceptible of low prices of sale to the consuming public, thereby making such cleaning apparatus economically available to the buying public.

Still yet another object of the present invention is to provide a new cleaning apparatus which provides in the apparatuses and methods of the prior art some of the advantages thereof, while simultaneously overcoming some of the disadvantages normally associated therewith.

Still another object of the present invention is to provide a new cleaning apparatus for cleaning with a rotary brush while delivery water to the area to be cleaned.

Yet another object of the present invention is to provide a new cleaning apparatus which includes a housing. The housing has a distal side and a proximal side. The housing has a top wall and a peripheral wall attached to and extending away from a peripheral edge of the top wall. The top wall and the peripheral wall bound an interior portion of the housing. The peripheral wall has a free edge. A washing means for washing a surface comprises a first scrubbing means for scrubbing a surface. The first scrubbing means is mounted in the housing. The first scrubbing means is generally adjacent to the free edge of the peripheral wall. A delivery means delivers liquid to the washing means and is fluidly coupled to the distal end of the housing.

Still yet another object of the present invention is to provide a new cleaning apparatus that contains an adjustable arm for bending into difficult to reach areas.

Even still another object of the present invention is to provide a new cleaning apparatus that can simultaneously deliver cleanser and water while utilizing a suction means to remove the water and cleanser as it is used.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
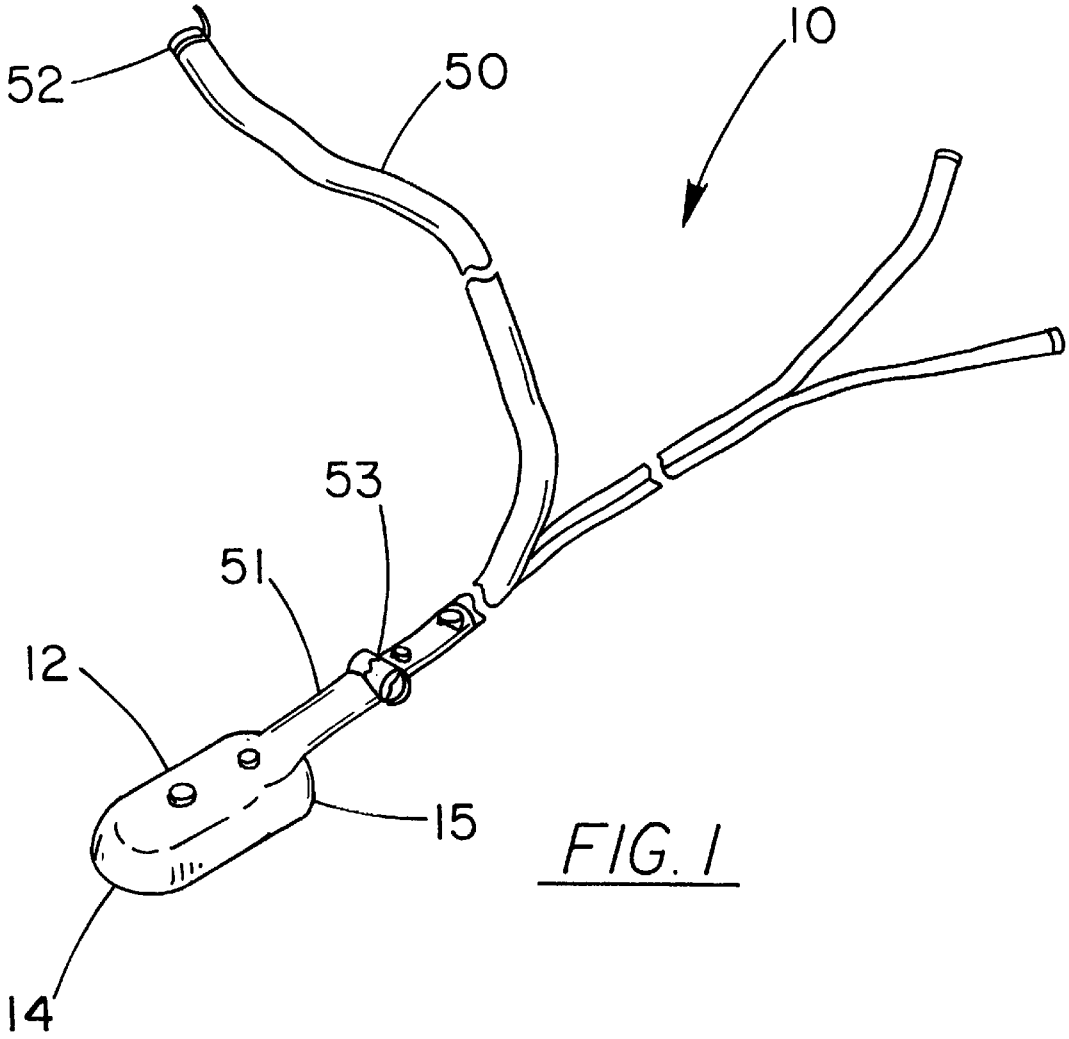
FIG. 1 is a schematic perspective view of a new cleaning apparatus according to the present invention.
Figure 2:
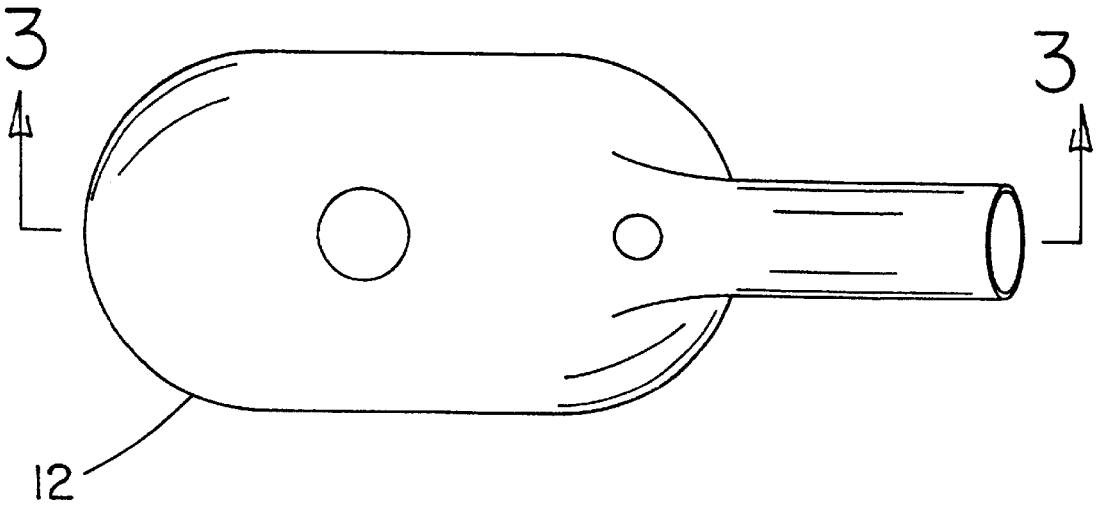
FIG. 2 is a schematic plan view of the housing of the present invention.
Figure 3:
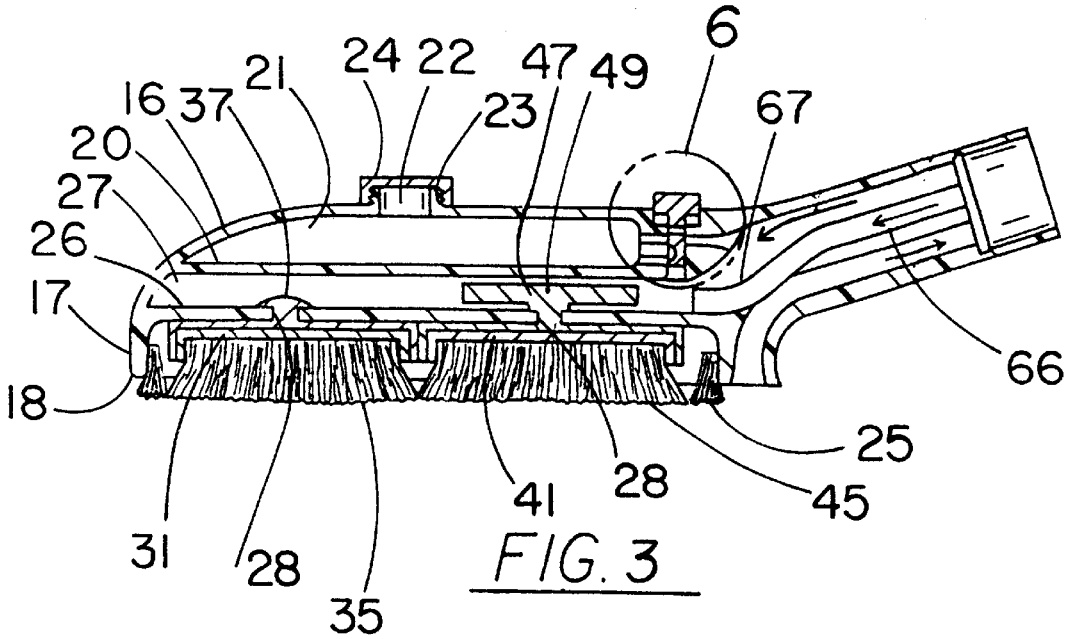
FIG. 3 is a schematic cross-sectional view taken along line 4—4 of the present invention.
Figure 4:
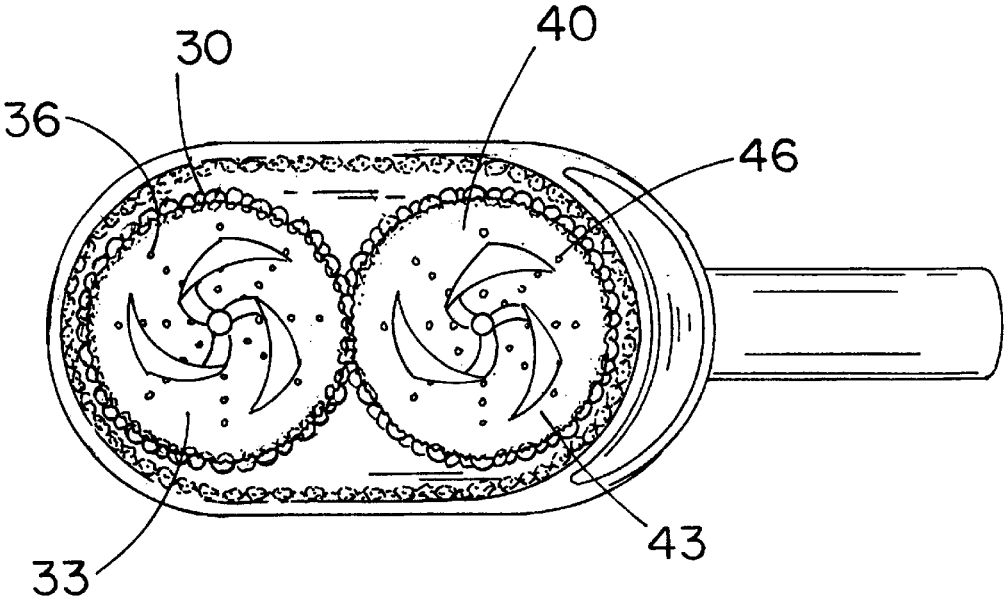
FIG. 4 is a schematic bottom plan view of the present invention.
Figure 5:
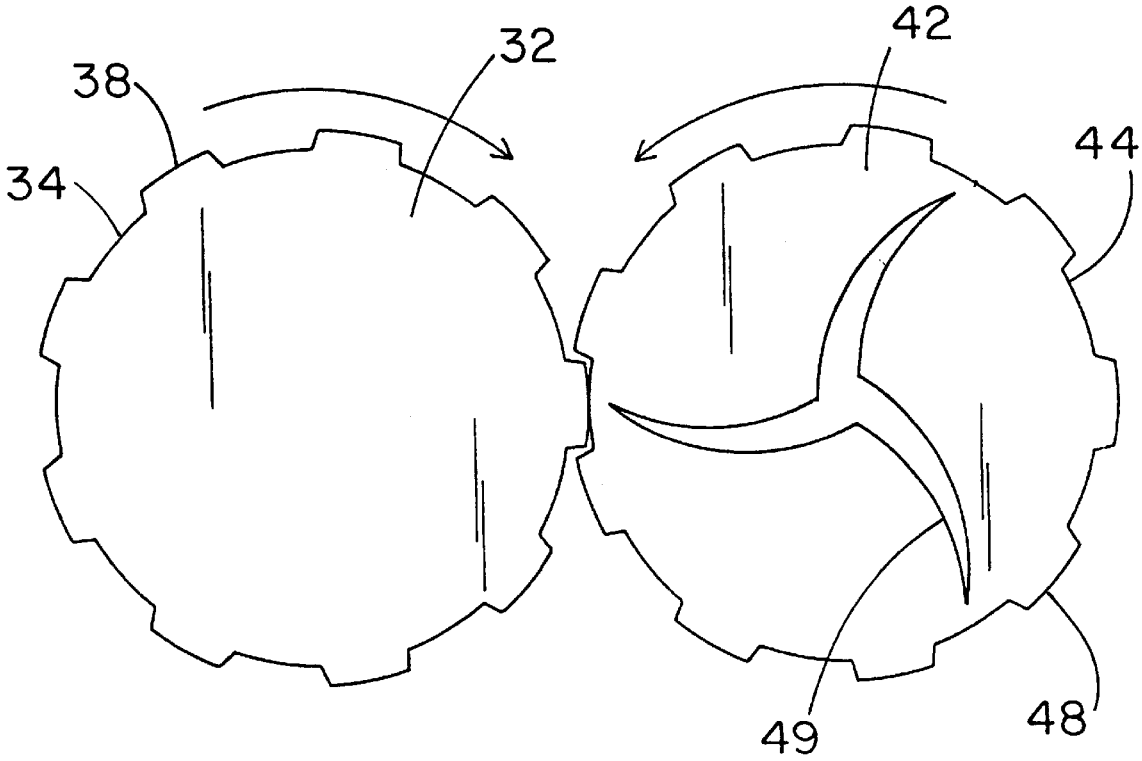
FIG. 5 is a schematic top view of the scrubbing means of the present invention.
Figure 6:
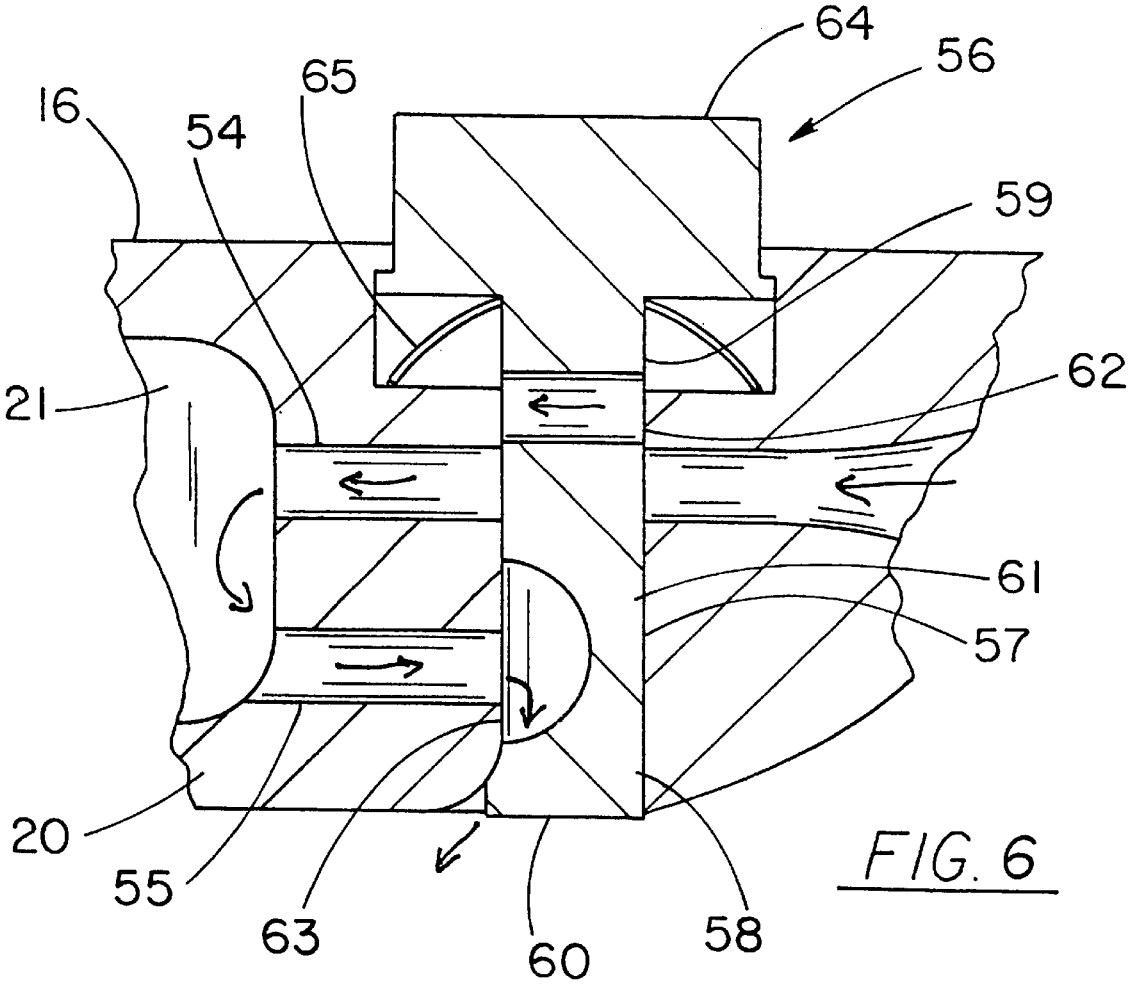
FIG. 6 is a schematic cross-sectional view of the canals of the present invention.

With reference now to the drawings, and in particular to FIGS. 1 through 9 thereof, a new cleaning apparatus embodying the principles and concepts of the present invention and generally designated by the reference numeral 10 will be described.

As best illustrated in FIGS. 1 through 9, the cleaning apparatus 10 generally comprises a housing 12 having a distal side 14 and a proximal side 15.

The housing 12 has a top wall 16 and a peripheral wall 17 attached to and extending away from a peripheral edge of the top wall. The top wall and the peripheral wall bound an interior portion of the housing. The peripheral wall 17 has a free edge 18. The top wall 16 has a generally oblong shape.

A first interior wall 20 forms a first cavity 21 in the housing 12. The first interior 20 wall has a peripheral edge integrally coupled to the peripheral wall 17. The first interior wall 20 is generally located between the free edge 18 of the peripheral wall 17 and the top wall 16. The first interior wall 20 is generally located nearer the top wall 16 than the free edge 18. The first interior wall 20 is oriented generally parallel to the top wall 16.

A first bore 22 in the top wall 16 extends into the first cavity 21 formed by the first interior wall 20. The first bore 22 has a lip 23 thereon. The lip 23 extends away from the first interior wall 20. The lip 23 has an outside surface has threads thereon. A cap 24 is adapted for removably coupling to the lip 23.

A plurality of bristles 25 is fixedly coupled to the peripheral wall 17. The bristles 25 extend away from the top wall 16 and are generally located adjacent to the free edge 18 of the peripheral wall.

A washing means for washing a surface comprises a second interior wall 26. The second interior wall 26 has an edge integrally coupled to the peripheral wall 17 of the housing 12. The second interior wall 26 defines a second cavity 27 formed by the first interior wall 20, the second interior wall 26 and the peripheral wall 17. The second interior wall 26 is generally located between the free edge 18 of the peripheral wall 17 and the first interior wall 20. The second interior wall 26 is orientated generally parallel to the first interior wall 20.

A pair of bores 28 extends through the second interior wall 26. Each of the bores 28 is generally located along a longitudinal axis of the second interior wall 26. Each of the bores is spaced from each other. A first of the bores is generally adjacent to the distal side 14 of the housing 12. A second of the bores is generally adjacent to the proximal side 15 of the housing 12.

A first scrubbing means 30 for scrubbing a surface has a base portion 31 having a top surface 32, a bottom surface 33 and a peripheral edge 34. The bottom surface 33 of the base portion has a plurality of bristles 35 affixed thereto. The bristles 35 extend away from the base portion 31 and are located generally adjacent to the peripheral edge 34 of the base portion 31. The base portion 31 has a plurality of bores 36 therein. The bores 36 radially extend from a central portion of the base portion. An upstanding member 37 is fixedly coupled to the central portion of the top surface 32 of the base portion 31. The upstanding member 37 is adapted to rotatably couple to the first bore 28 in the second interior wall 26. The base portion 31 of the first scrubbing means has a generally circular shape. The peripheral edge 34 of the base portion has teeth 38 therein.

A second scrubbing means 40 for scrubbing a surface has a base portion 41. The base portion has a top surface 42, a bottom surface 43 and a peripheral edge 44. The bottom surface of the base portion has a plurality of bristles 45 affixed thereto. The bristles 45 extend away from the base portion 41. The bristles 45 are located generally adjacent to the peripheral edge 44 of the base portion. The base portion 41 has a plurality of bores 46 therein. The bores 46 radially extend from a central portion of the base portion 41. An upstanding member 47 is fixedly coupled to the central portion of the top surface of the base portion. The upstanding member 47 is adapted to rotatably couple to the second bore 28 in the second interior wall 26. The base portion 41 of the second scrubbing means 40 has a generally circular shape. The peripheral edge 44 of the base portion 41 of the second scrubbing means 40 has teeth 48 therein for selectively coupling with the teeth 38 on the first scrubbing means 30.

An impeller rotates 49 the second scrubbing means 40 as water passes it which, in turn, rotates the first scrubbing means 30. The impeller 49 is fixedly mounted to the upstanding member 47 of the second scrubbing means 40. The impeller 49 has a rotational axis orientated generally perpendicular to a plane of the second interior wall 26. The impeller 49 is located in the second cavity 27.

A delivery means delivers liquid to the washing means. The delivery means comprises an elongate member 50. The elongate member is substantially hollow and has a first end 51, a second end 52 and a middle portion 53. The first end 51 of the elongate member 50 is integrally coupled to the distal side 15 of the housing 12 such that an interior portion of the elongate member 50 is exposed to the second cavity 27. The middle portion 53 of the elongate member is adapted to be selectively angled.

A first canal 54 connects the first cavity 21 and the elongate member 50. The first canal 54 extends between the first cavity 21 and the interior of the elongate member 50. The first canal 54 is generally adjacent to the top wall 16.

A second canal 55 connects the first cavity 21 to the second cavity 27. The second canal 55 is located generally between the first canal 54 and the second cavity 27 and generally adjacent to the first canal 54.

A first valve 56 allows the opening of the first 54 and second 55 canals. The first valve 56 comprises a bore 57 extending between the top wall 16 and into the second cavity 27. The bore 57 extends through the first canal 54 and the second canal 55. An arm 58 is adapted to fit in the bore 57. The arm 58 has a first end 59, a second end 60 and middle portion 61. The middle portion 61 of the arm has a bore 62 and a slot 63 therein. The bore 62 and slot 63 are located such that when the bore 62 is aligned with the first canal 54, the slot 63 is aligned with the second canal 55. A button 64 for actuating the first valve is mounted in the top wall 16. The button 64 is fixedly coupled to the first end 59 of the arm 58. A spring 65 urges the button 64 away from the first canal 54. Actuating the first valve fluidly connects the bore 62 in the arm 58 with the first canal 54.

A first tube 66 has a first end 67, a second end, not shown, and a middle portion 68. The first tube 66 extends through the elongate member 50. The first end 67 is fluidly connected with the second cavity 27. A second valve 69 extends through the elongate member 50. The second valve 68 is adapted for selectively closing the middle portion 68 of the first tube 66. The first tube 66 is also fluidly coupled to the first canal 54.

A second tube 70 has a first end 71, a second end, not shown, and a middle portion 72. The second tube 70 extends through the elongate member 50. The first end 71 extends through the peripheral wall 17 and is generally located adjacent to the free edge 18 of the peripheral wall. A third valve 73 extends through the elongate member 50. The third valve 73 is adapted for selectively closing the middle portion 72 of the second tube 70.

Figure 7:
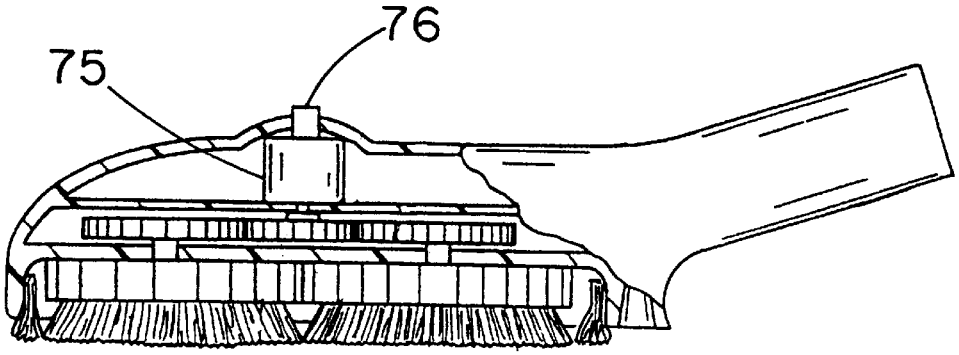
FIG. 7 is a schematic cross-sectional view of the second embodiment of the present invention.
Figure 8:
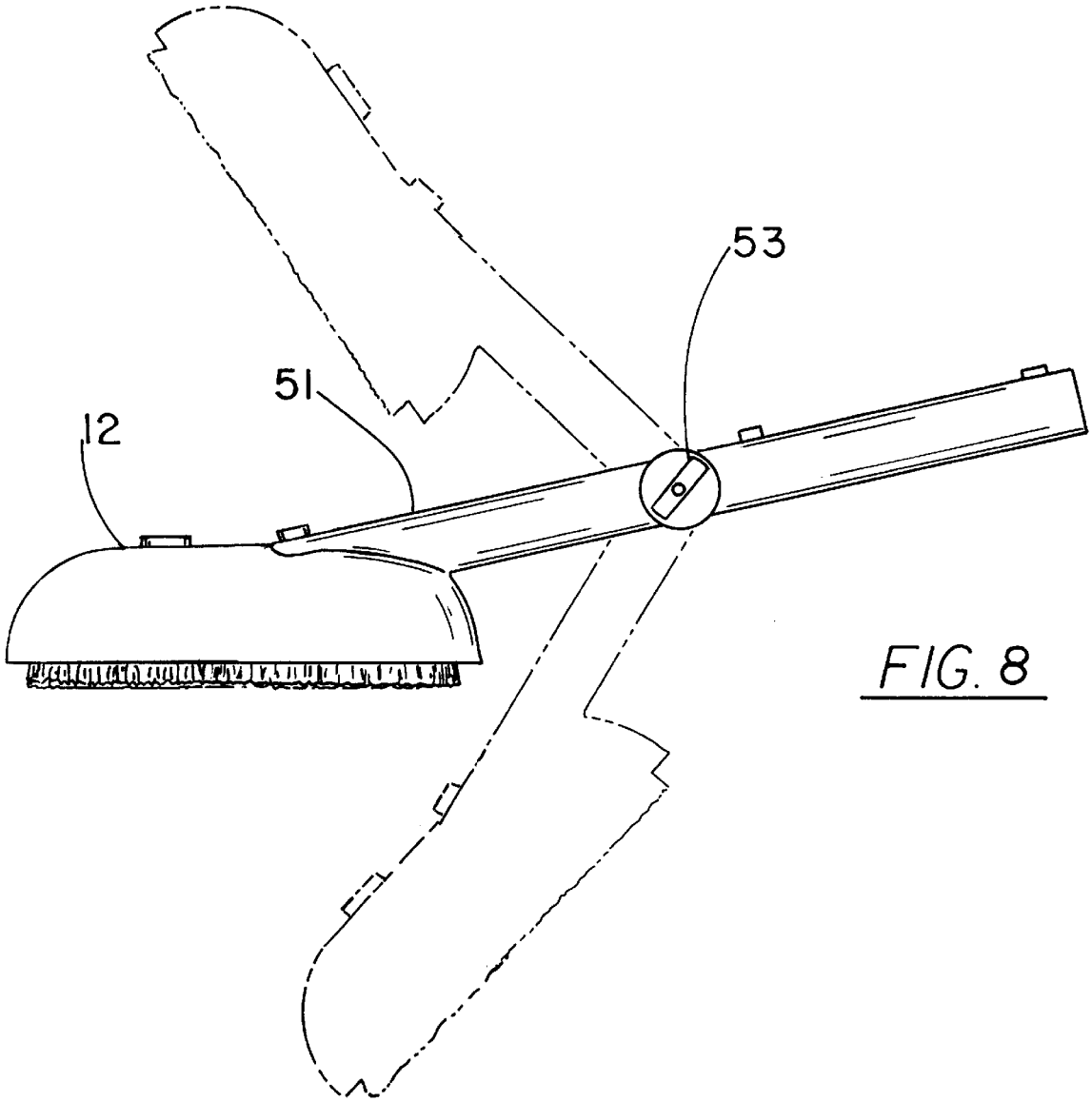
FIG. 8 is a schematic side view of the showing the bendable elongate member of the present invention.
Figure 9:
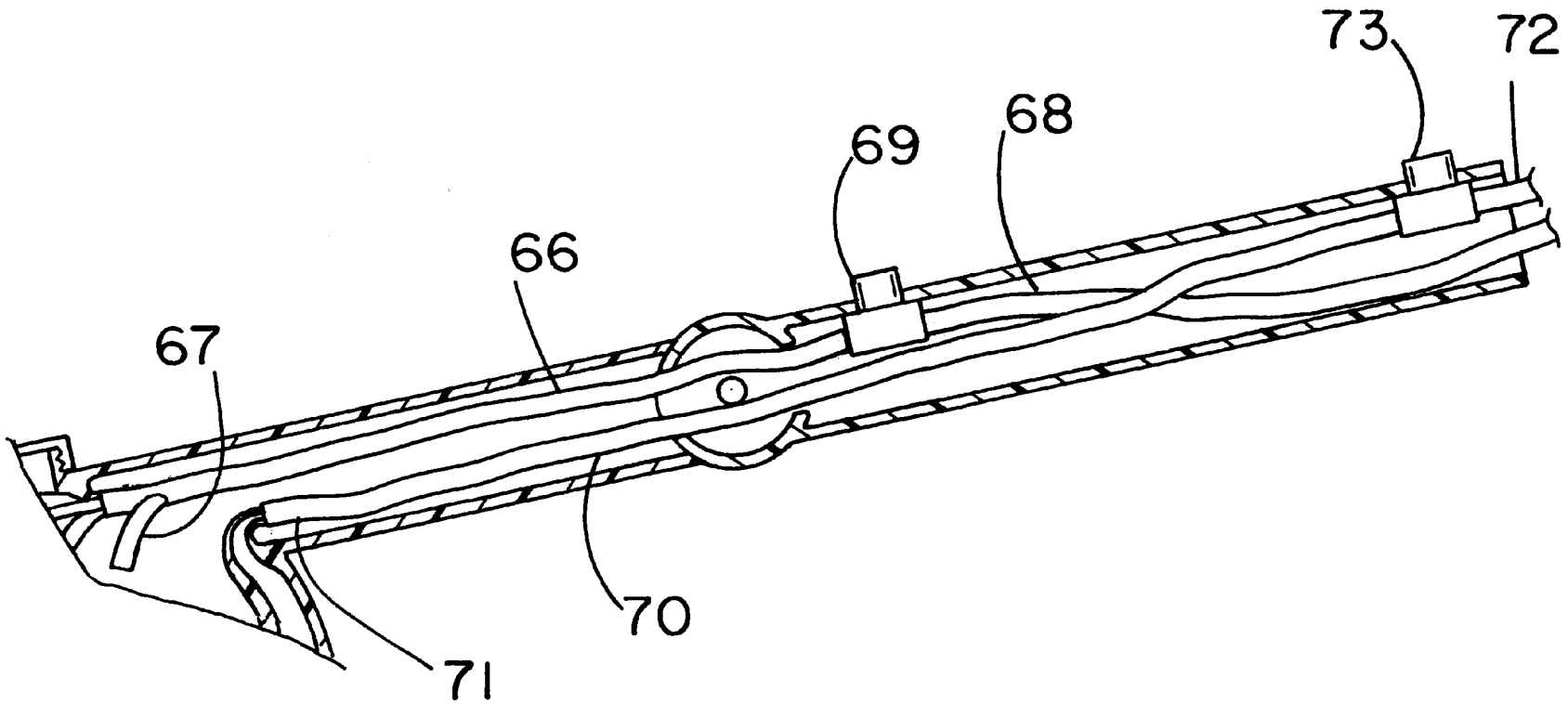
FIG. 9 is a schematic cross-sectional view of the elongate member of the present invention.

A second embodiment is best depicted in FIG. 7. FIG. 7 shows a motor 75 that is operationally coupled to the scrubbing means. The motor is coupled to an actuating means 76 that is used to actuate the motor. The motor turns the scrubbing means without the need for running water.

In use, the first cavity 21 may be filled with a liquid cleanser, the second end of the first tube 66 may be removably coupled to a water supply, and the second end of the second tube 70 may be removably coupled to a suction means such as a vacuum. The water supply enters the second cavity 27 and rotates the first 30 and second 40 scrubbing means. The water then exits the housing around the second wall 26 and through bores 36, 46 in the scrubbing means.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cleaning apparatus comprising:

a housing having a distal side and a proximal side, said housing comprising;

said housing having a top wall and a peripheral wall attached to and extending away from a peripheral edge of said top wall, an interior portion of said housing being bounded by said top wall and said peripheral wall, said peripheral wall having a free edge;

a first interior wall for forming a first cavity in said housing, said first interior wall having a peripheral edge being integrally coupled to said peripheral wall, said first interior wall being generally located between said free edge of said peripheral wall and said top wall, said first interior wall being generally located nearer said top wall than said free edge, said first interior wall being oriented generally parallel to said top wall;

a second interior wall having an edge integrally coupled to said peripheral wall of said housing, said second interior wall being generally located between said free edge of said peripheral wall and said first interior wall such that a second cavity is defined between said second interior wall and said first interior wall;

a first bore in said top wall, said first bore extending into said first cavity formed by said first interior wall, said first bore having a lip thereon, said lip extending away from said first interior wall, said lip having an outside surface having threads thereon;

a cap, said cap being adapted for removably coupling to said lip, wherein said first cavity is in communication with a delivery means;

a washing means for washing a surface, said washing means comprising:

a first scrubbing means for scrubbing a surface, said first scrubbing means being mounted in said housing, said first scrubbing means being generally adjacent to said free edge of said peripheral wall, said first scrubbing means being rotatably coupled to said second interior wall, said second interior wall being positioned between said first scrubbing means and said first interior wall;

a delivery means for delivering liquid to said washing means, said delivery means being fluidly coupled to said distal side of said housing;

a plurality of bristles, said bristles being fixedly coupled to said peripheral wall, said bristles extending away from said top wall, said bristles being generally located adjacent to said free edge of said peripheral wall; and an elongate member, said elongate member being substantially hollow, said elongate member having a first end, a second end and a middle portion, said first end of said elongate member being integrally coupled to said proximal side of said housing such that an interior portion of said elongate member is exposed to said second cavity.

2. The cleaning apparatus as in claim 1, said delivery means further comprising:

a first canal for connecting said first cavity and said elongate member, said first canal extends between said first cavity and said interior of said elongate member, said first canal being generally adjacent to said top wall;

a second canal for connecting said first cavity to said second cavity, said second canal being located generally between said first canal and said second cavity and generally adjacent to said first canal; and a first valve for allowing opening said first and second canals.

3. The cleaning apparatus as in claim 2, said delivery means comprising:

a first tube, said first tube having a first end, a second end and a middle portion, said first tube extending through said elongate member, said first end being fluidly connected with said second cavity, a second valve extending through said elongate member, said second valve being adapted for selectively closing said middle portion of said first tube.

4. The cleaning apparatus as in claim 3, said delivery means further comprising:

a second tube, said second tube having a first end, a second end and a middle portion, said second tube extending through said elongate member, said first end extending through said peripheral wall and being generally located adjacent to said free edge of said peripheral wall, a third valve extending through said elongate member, said third valve being adapted for selectively closing said middle portion of said second tube.

5. A cleaning apparatus, said apparatus comprising:

a housing, said housing having a distal side and a proximal side, said housing comprising;

a top wall and a peripheral wall attached to and extending away from a peripheral edge of said top wall, an interior portion of said housing being bounded by said top wall and said peripheral wall, said peripheral wall having a free edge, said top wall having a generally oblong shape;

a first interior wall for forming a first cavity in said housing, said first interior wall having a peripheral edge being integrally coupled to said peripheral wall, said first interior wall being generally located between said free edge of said peripheral wall and said top wall, said first interior wall being generally located nearer said top wall than said free edge, said first interior wall being oriented generally parallel to said top wall;

a first bore in said top wall, said first bore extending into said first cavity formed by said first interior wall, said first bore having a lip thereon, said lip extending away from said first interior wall, said lip having an outside surface having threads thereon;

a cap, said cap being adapted for removably coupling to said lip;

a plurality of bristles, said bristles being fixedly coupled to said peripheral wall, said bristles extending away from said top wall, said bristles being generally located adjacent to said free edge of said peripheral wall;

a washing means for washing a surface, said washing means comprising:

a second interior wall, said second interior wall having an edge integrally coupled to said peripheral wall of said housing, said second interior wall defining a second cavity formed from said first interior wall, said second interior wall and said peripheral wall, said second interior wall being generally located between said free edge of said peripheral wall and said first interior wall, said second interior wall being orientated generally parallel to said first interior wall;

a pair of bores extending through said second interior wall, each of said bores being generally located along a longitudinal axis of said second interior wall, each of said bores being spaced from each other, a first of said bores being generally adjacent to said distal side of said housing, a second of said bores being generally adjacent to said proximal side of said housing;

a first scrubbing means for scrubbing a surface, said first scrubbing means having a base portion, said base portion having a top surface, a bottom surface and a peripheral edge, said bottom surface of said base portion having a plurality of bristles affixed thereto, said bristles extending away from said base portion, said bristles being located generally adjacent to said peripheral edge of said base portion, said base portion having a plurality of bores therein, said bores radially extending from a central portion of said base portion, an upstanding member being fixedly coupled to said central portion of said top surface of said base portion, said upstanding member being adapted to rotatably couple to said first bore in said second interior wall, said base portion of said first scrubbing means having a generally circular shape, said peripheral edge of said base portion having teeth therein;

a second scrubbing means for scrubbing a surface, said second scrubbing means having a base portion, said base portion having a top surface, a bottom surface and a peripheral edge, said bottom surface of said base portion having a plurality of bristles affixed thereto, said bristles extending away from said base portion, said bristles being located generally adjacent to said peripheral edge of said base portion, said base portion having a plurality of bores therein, said bores radially extending from a central portion of said base portion, an upstanding member being fixedly coupled to said central portion of said top surface of said base portion, said upstanding member being adapted to rotatably couple to said second bore in said second interior wall, said base portion of said second scrubbing means having a generally circular shape, said peripheral edge of said base portion of said second scrubbing means having teeth therein for selectively coupling with said teeth on said first scrubbing means;

an impeller for rotating said second scrubbing means, said impeller being fixedly mounted to said upstanding member of said second scrubbing means, said impeller having a rotational axis orientated generally perpendicular to a plane of said second interior wall, said impeller being located in said second cavity;

a delivery means for delivering liquid to said washing means, said delivery means comprising:

an elongate member, said elongate member being substantially hollow, said elongate member having a first end, a second end and a middle portion, said first end of said elongate member being integrally coupled to said proximal side of said housing such that an interior portion of said elongate member is exposed to said second cavity, said middle portion of said elongate member being adapted to being selectively angled;

a first canal for connecting said first cavity and said elongate member, said first canal extends between said first cavity and said interior of said elongate member, said first canal being generally adjacent to said top wall;

a second canal for connecting said first cavity to said second cavity, said second canal being located generally between said first canal and said second cavity and generally adjacent to said first canal;

a first valve for allowing opening said first and second canals, said first valve comprising:

a bore, said bore extending between said top wall and into said second cavity, said bore extending through said first canal and said second canal;

an arm, said arm being adapted to fit in said bore, said arm having a first end, a second end and middle portion, said middle portion of said arm having a bore and a slot therein, wherein said bore and slot are located such that when said bore is aligned with said first canal said slot is aligned with said second canal;

a button for actuating said first valve, said button being mounted in said top wall, said button being fixedly coupled to said first end of said arm;

a spring for urging said button away from said first canal;

wherein actuating said first valve fluidly connects said bore in said arm with said first canal;

a first tube, said first tube having a first end, a second end and a middle portion, said first tube extending through said elongate member, said first end being fluidly connected with said second cavity, a second valve extending through said elongate member, said second valve being adapted for selectively closing said middle portion of said first tube;

a second tube, said second tube having a first end, a second end and a middle portion, said second tube extending through said elongate member, said first end extending through said peripheral wall and being generally located adjacent to said free edge of said peripheral wall, a third valve extending through said elongate member, said third valve being adapted for selectively closing said middle portion of said second tube; and wherein said first cavity may be filled with a liquid cleanser, wherein said second end of said first tube may be removably coupled to a water supply, wherein said second end of said second tube may be removably coupled to a suction means.

6. A cleaning apparatus, said apparatus comprising:

a housing having a distal side and a proximal side, said housing including;

a top wall and a peripheral wall attached to and extending away from a peripheral edge of said top wall, an interior portion of said housing being bounded by said top wall and said peripheral wall, said peripheral wall having a free edge;

a first interior wall for forming a first cavity in said housing, said first interior wall having a peripheral edge being integrally coupled to said peripheral wall, said first interior wall being generally located between said free edge of said peripheral wall and said top wall, said first interior wall being generally located nearer said top wall than said free edge, said top wall having a first bore therein extending into said first cavity, said first bore having an edge having a lip thereon extending away from said first interior wall, said lip having a threaded outer surface;

a cap being adapted for removably coupling to said lip, wherein said first cavity is in communication with said delivery means.

a second interior wall having an edge integrally coupled to said peripheral wall of said housing, said second interior wall being positioned between said free edge of said peripheral wall and said first interior wall such that a second cavity is defined between said first and second interior walls;

a washing means for washing a surface, said washing means comprising;

a first scrubbing means for scrubbing a surface, said first scrubbing means being mounted in said housing, said first scrubbing means being generally adjacent to said free edge of said peripheral wall, said first scrubbing means having a base portion, said base portion having a top surface, a bottom surface and a peripheral edge, said bottom surface of said base portion having a plurality of bristles affixed thereto, said bristles extending away from said base portion, said base portion having a plurality of bores therein, an upstanding member being fixedly coupled to said central portion of said top surface of said base portion, said upstanding member being rotatably coupled to said second interior wall; and a delivery means for delivering liquid to said washing means, said delivery means being fluidly coupled to said distal side of said housing.

7. The cleaning apparatus as in claim 6, said housing further comprising a plurality of bristles fixedly coupled to said peripheral wall, said bristles extending away from said top wall, said bristles being generally located adjacent to said free edge of said peripheral wall.

8. The cleaning apparatus as in claim 6, wherein said base portion of said first scrubbing means has a generally circular shape, said peripheral edge of said base portion having teeth therein.

9. The cleaning apparatus as in claim 8, further comprising:

a second scrubbing means for scrubbing a surface, said second scrubbing means having a base portion, said base portion having a top surface, a bottom surface and a peripheral edge, said bottom surface of said base portion having a plurality of bristles affixed thereto, said bristles extending away from said base portion, said bristles being located generally adjacent to said peripheral edge of said base portion, said base portion having a plurality of bores therein, an upstanding member being fixedly coupled to said central portion of said top surface of said base portion, said upstanding member being rotatably coupled to said second interior wall, said base portion of said second scrubbing means having a generally circular shape, said peripheral edge of said base portion of said second scrubbing means having teeth therein for selectively coupling with said teeth on said first scrubbing means; and an impeller for rotating said second scrubbing means, said impeller being fixedly mounted to said upstanding member of said second scrubbing means, said impeller having a rotational axis orientated generally perpendicular to a plane of said second interior wall, said impeller being located in said second cavity.

* * * * *